United States Patent [19]

Granzow et al.

[11] Patent Number: 4,638,993

[45] Date of Patent: Jan. 27, 1987

[54] POSITION CONTROL FOR A STACKER WHEEL

[75] Inventors: Robert H. Granzow, Miamisburg; Desh B. Gupta, Dayton, both of Ohio

[73] Assignee: NCR Corporation, Dayton, Ohio

[21] Appl. No.: 278,273

[22] Filed: Jun. 29, 1981

[51] Int. Cl.[4] ..... B65H 29/20

[52] U.S. Cl. ..... 271/315; 271/187

[58] Field of Search ..... 271/315, 178, 187, 176, 271/270, 202, 69; 414/81, 107

[56] References Cited

U.S. PATENT DOCUMENTS

| | | | |
|---|---|---|---|
| 3,512,771 | 5/1970 | Dempsey et al. | 271/187 X |
| 3,531,108 | 9/1970 | Rabinow et al. | 271/305 |
| 3,719,267 | 3/1973 | Reist et al. | 271/270 X |
| 4,088,314 | 5/1978 | Phillips | 271/187 X |
| 4,244,565 | 1/1981 | Geier | 271/187 X |
| 4,275,874 | 6/1981 | DiBlasio | 271/4 |

FOREIGN PATENT DOCUMENTS

| | | | |
|---|---|---|---|
| 2907831 | 8/1979 | Fed. Rep. of Germany | 271/9 |
| 2016426A | 9/1979 | United Kingdom . | |

*Primary Examiner*—Douglas C. Butler

*Attorney, Agent, or Firm*—Albert L. Sessler, Jr.; Elmer Wargo

[57] ABSTRACT

A position controller for a stacker wheel in a media dispensing apparatus including a stacker wheel rotatably mounted in said apparatus with the stacker wheel having compartments located around the periphery thereof, with each compartment having spaced ends providing an entrance area to the associated one of the compartments. A transport mechanism is used for transporting media in spaced relationship along a path leading to a loading area with regard to the stacker wheel. A detector is used for detecting the presence of a leading edge of one of said media in the path at a predetermined point from the loading area and also for generating a first signal in response thereto. A slotted disc and detector are used for determining the rotational position of each compartment of the stacker wheel with regard to the loading area to produce a second signal indicative of that position. The position controller rotates the stacker wheel and also varies the velocity (when necessary) of the stacker wheel in response to the first and second signals so as to enable the leading edge of one of said media to be moved into a compartment by the transport mechanism without contacting the associated ends.

8 Claims, 9 Drawing Figures

FIG. 5
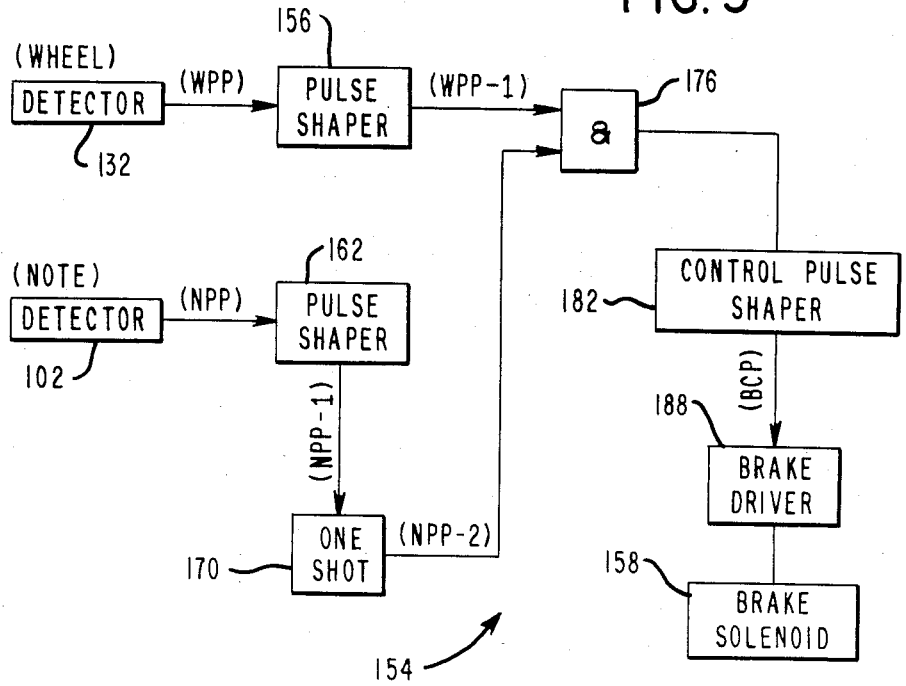
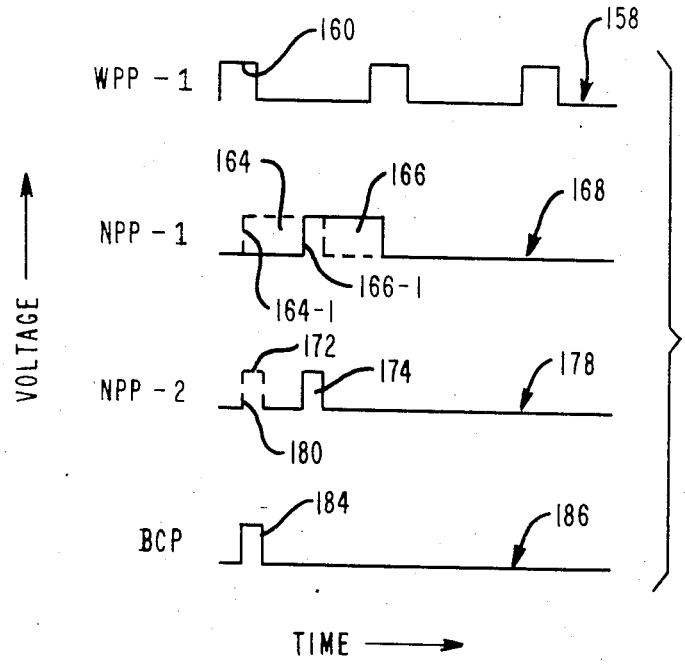
FIG. 6

POSITION CONTROL FOR A STACKER WHEEL

BACKGROUND OF THE INVENTION

This invention relates to an apparatus for controlling the position of a stacker wheel used in a machine for dispensing media such as currency, notes, and the like, so as to receive media which are asynchronously fed thereto without jamming or malfunction.

Currency or note dispensing machines, commonly called automated teller machines, include magazines for storing notes or bills of different denominations. An authorized user or customer of the machine may request a monetary amount from the machine, and in response thereto, the machine dispenses the correct number of notes, including notes of different denominations, when necessary.

In some of these machines, the notes requested are stacked or placed in a neat pile prior to being made accessible to the customer. Such stacking may be effected by a stacker wheel.

A stacker wheel is a generally-cylindrically-shaped wheel which has a plurality of spaced, finger ends around the periphery thereof, with adjacent finger ends defining the limits of a compartment formed therebetween. The notes to be dispensed coming from the various magazines are inserted successively into these compartments from an adjacent loading station as the stacker wheel is rotated. A stationary pick-off member, which is displaced circumferentially from the loading station, is used to separate the notes from the stacker wheel and thereby stack them in a neat pile prior to being made accessible to a customer.

When the notes which are picked from the different magazines of the dispensing machine arrive at a loading station associated with the stacker wheel, they generally arrive there asynchronously. With this type of arrival, it is likely that an arriving note will hit one of the finger ends instead of being inserted into a compartment without hitting one of the finger ends.

When an arriving note hits one of the finger ends of the rotating stacker wheel, the following malfunctions may occur:

1. The stacker wheel and associated mechanisms may become jammed.
2. The note being fed may become torn or disfigured.
3. The notes being fed may not actually be dispensed to a customer.
4. Various combinations of the above malfunctions may occur.

SUMMARY OF THE INVENTION

The apparatus of this invention comprises: a stacker wheel rotatably mounted in said apparatus; said stacker wheel having stacking compartments located around the periphery thereof with each said compartment having spaced ends providing an entrance area to the associated one of said compartments; means for transporting media in spaced relationship along a path leading to a loading area with regard to said stacker wheel; means for detecting the presence of a leading edge of one of said media in said path at a predetermined point from said loading area and also for generating a first signal in response thereto; means for determining the rotational position of each said compartment of said stacker wheel with regard to said loading area to produce a second signal indicative of said position; and means for rotating said stacker wheel and also for varying the velocity (when necessary) of said stacker wheel in response to said first and second signals so as to enable the leading edge of one of said media to enter a said compartment without contacting the associated said ends.

The apparatus of this invention is inexpensive to manufacture and install in a currency dispensing machine and obviates the various malfunctions enumerated earlier herein.

BRIEF DESCRIPTION OF THE DRAWING

FIG. 5 is a schematic diagram, in block form, showing a circuit associated with the embodiment of the invention shown in FIG. 2;

FIG. 6 shows a plurality of timing diagrams associated with the circuit shown in FIG. 5;

DETAILED DESCRIPTION OF THE INVENTION

Figure 1:
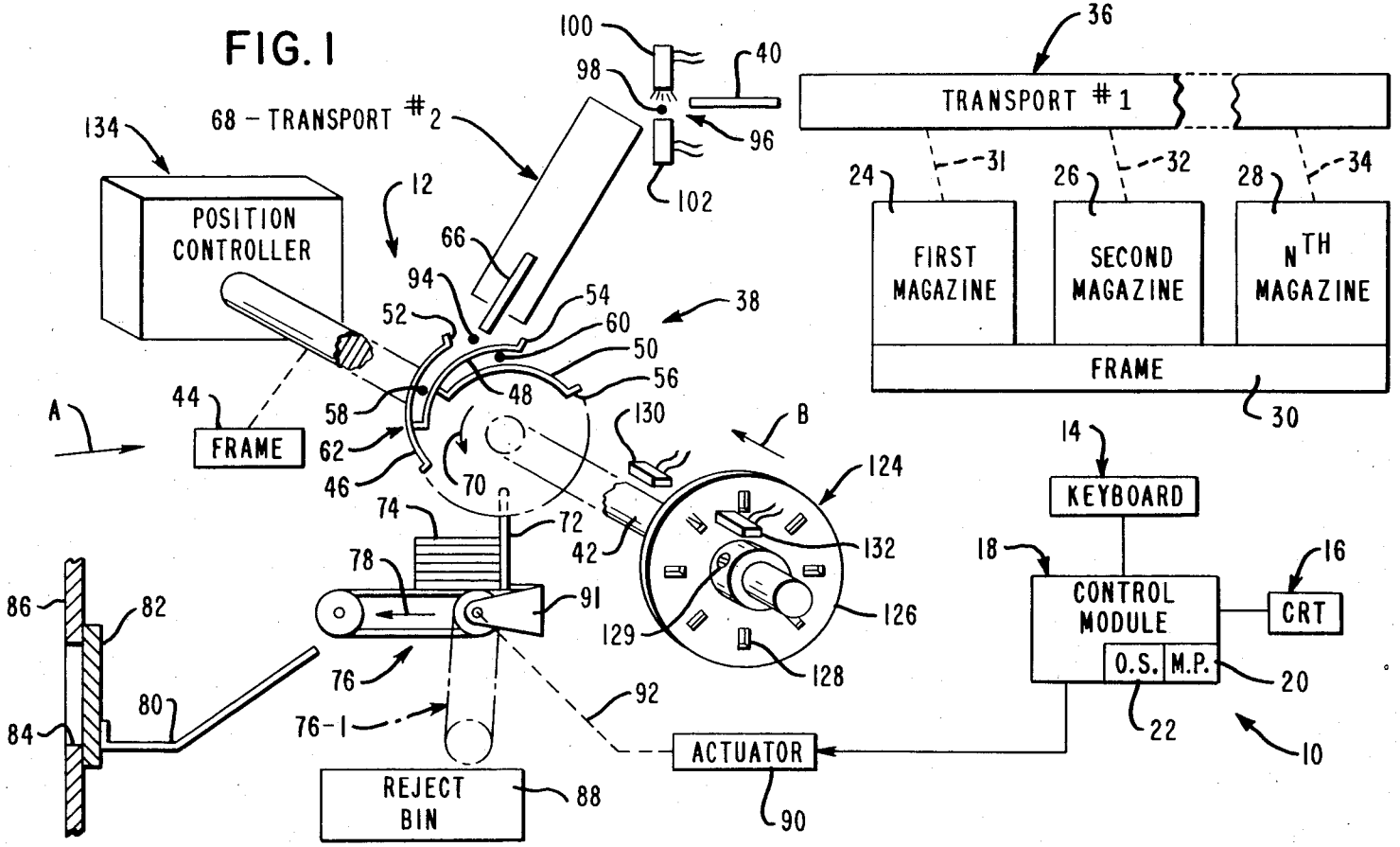
FIG. 1 is a diagrammatic view showing certain basic elements included in a currency dispensing machine, and also showing the apparatus of this invention in such a machine.

FIG. 1 is a diagrammatic view of a currency dispensing machine designated generally as 10 in which the apparatus 12 of this invention may be used.

The machine 10 (FIG. 1) includes, very generally, a keyboard 14 for entering data therein, a cathode ray tube (CRT) 16 for displaying data thereon to assist a user in the operation of the machine 10, and a control module 18 for controlling the operation of the machine 10. The control module 18 includes, among other elements, a processor such as a microprocessor (MP) 20 and an operating system (OS) 22. The OS 22 includes the necessary memory and related devices for storing the various application programs and procedures for effecting control and operation of the machine 10 in a conventional manner.

The machine 10 (FIG. 1) also includes a plurality of magazines such as 24, 26, and 28 which are mounted in the frame 30 of the machine and are used for storing different denominations of currency. For example, the first magazine 24 may store $1 notes in U.S. currency, the second magazine 26 may store $5 notes, and the nth magazine 28 may store $20 notes. The desired numbers of notes are withdrawn from the magazines 24, 26, and 28 by conventional picker mechanisms 31, 32, and 34, respectively, which are shown only as dashed lines (to simplify the drawing), and these notes are fed in a conventional transport #1 (also designated 36) towards the stacker wheel designated generally as 38 which is part of the apparatus 12. In the embodiment described, the notes like note 40 are oriented with the widths showing in the drawing and with the lengths of the notes extending into the plane of the drawing.

As earlier stated herein, the apparatus 12 (FIG. 1) includes a conventional stacker wheel 38 which is fixed to a shaft 42 which is rotatably mounted in a portion 44 of the frame 30 which is shown only diagrammatically. The wheel 38 has a plurality of arcuately shaped fingers like 46, 48, and 50 which are formed around the periphery thereof. Only a few of the fingers like 46, 48 and 50 are shown in the drawing so as to simplify it, and each of these fingers has ends 52, 54, and 56, respectively, which are bent outwardly so as to guide a note into compartments like 58 and 60. For example, compartment 58 is formed by adjacent fingers 46 and 48, and similarly, compartment 60 is formed by adjacent fingers 48 and 50. The fingers 46, 48 and 50, for example, form one set of fingers which is designated generally as 62 and the stacker wheel 38 has a second set of identical fingers 64 which is shown in FIG. 2.

Figure 2:
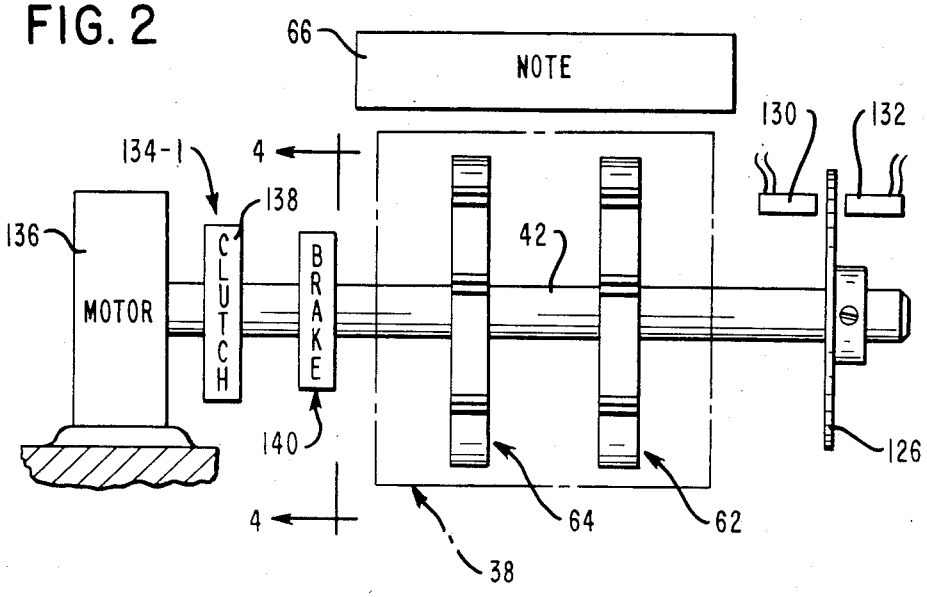
FIG. 2 is a diagrammatic view, in elevation, showing more details of a stacker wheel shown in FIG. 1 as used in a first embodiment of this invention.

FIG. 2 is a diagrammatic view, in elevation, and is taken from the direction of arrow A in FIG. 1 to show additional details of the stacker wheel 38. The first and second sets of fingers 62 and 64 are shown in spaced relation as seen in FIG. 2. The wheel 38 is cylindrical in form and is shown only in dashed outline in FIG. 2. The length of a note 66 is visible in FIG. 2 while its width is shown in FIG. 1. The note 66 in FIG. 1 is shown in the process of being fed into the compartment 58 by a conventional transport #2 which is designated as 68 and is shown only as a block to simplify the drawing.

In a conventional cash dispensing machine, a stacker wheel like 38 (FIG. 1) is rotated in the direction of arrow 70 at a constant velocity as the notes like 66 are inserted sequentially into the associated compartments like 58 and 60. As the wheel 38 rotates, the notes like 66 are inserted (at high relative velocity) in a compartment like 58 and are carried around the wheel 38 and abut against a stationary finger stop 72 (shown in dashed outline in FIG. 1) where they collect to form a pile or stack 74. The stack 74 rests on a conventional transport mechanism such as a short, endless-belt-type conveyor 76. When the correct number of notes to be dispensed accumulates in the stack 74, the conveyor 76 is driven in the direction of arrow 78 (by a motor not shown) under the control of the control module 18, and the stack 74 of notes is deposited into a container 80. Thereafter, the control module 18 initiates the opening of an access door 82 (which covers an access opening 84 in the front panel 86 of the machine 10) to permit a customer to gain access to the notes lying in the container 80. After a time interval, the control module 18 initiates movement of the door 82 to close the access opening 84. If for some reason such as a suspected miscount of notes, for example, the control module 18 decides to dump the stack 74 of notes into the reject bin 88 located within the machine 10, the control module 18 will energize a conventional actuator 90 to pivot the conveyor to the position shown in dashed outline 76-1 to thereby dump the stack 74 of notes into the bin 88 instead of having the stack 74 deposited in the container 80. One end of conveyor 76 is pivotally joined to the frame member 91 and suitable linkage shown only as dashed line 92 is used to interconnect the conveyor 76 with the actuator 90 for the pivoting action.

As earlier stated herein, when notes were fed asynchronously along transports 36 and 68 to the stacker wheel 38 (FIG. 1), the leading edge of a note like 66 tended to strike the finger ends like 52 and 54 instead of entering the associated compartment 58 therebetween. This produced the several malfunctions enumerated earlier herein.

The apparatus 12 (FIG. 1) of this invention includes the stacker wheel 38 as previously described. The space between adjacent finger ends such as 52 and 54 provides an entrance area to the associated compartment 58. The transport 68 positions the leading edge of a note at a loading area with regard to the wheel 38 and this loading area is represented by a point 94 in FIG. 1, although it exists as a line (not shown) in FIG. 2. As the note 66 is discharged from the transport 68, the leading edge thereof enters the loading area represented by point 94 and is inserted into the associated compartment 58 without hitting the associated finger ends 52 and 54.

The apparatus 12 (FIG. 1) also includes means 96 for detecting the presence of the leading edge of a note like 40 in the transport path (represented by transports 36 and 68) at a predetermined point 98 from the loading point 94. The detecting means 96 includes a light source 100 and an associated detector 102. When the leading edge of a note like 40 reaches the point 98, an output or first signal will be generated by the detector 102 to indicate that the leading edge of the note is located at a predetermined distance from the loading point 94. The transport 68 may include conventional endless belts or drive rollers (not shown) for moving a note like 40 at a constant velocity from point 98 to the loading point 94. Prior to reaching point 98, the notes like 40 are checked or examined to conventionally detect doubles or overlapping notes, and when found, such notes are diverted away from transport 68 by conventional detector and diverting apparatus not important to an understanding of this invention, and therefore, they are not shown.

Figure 3:
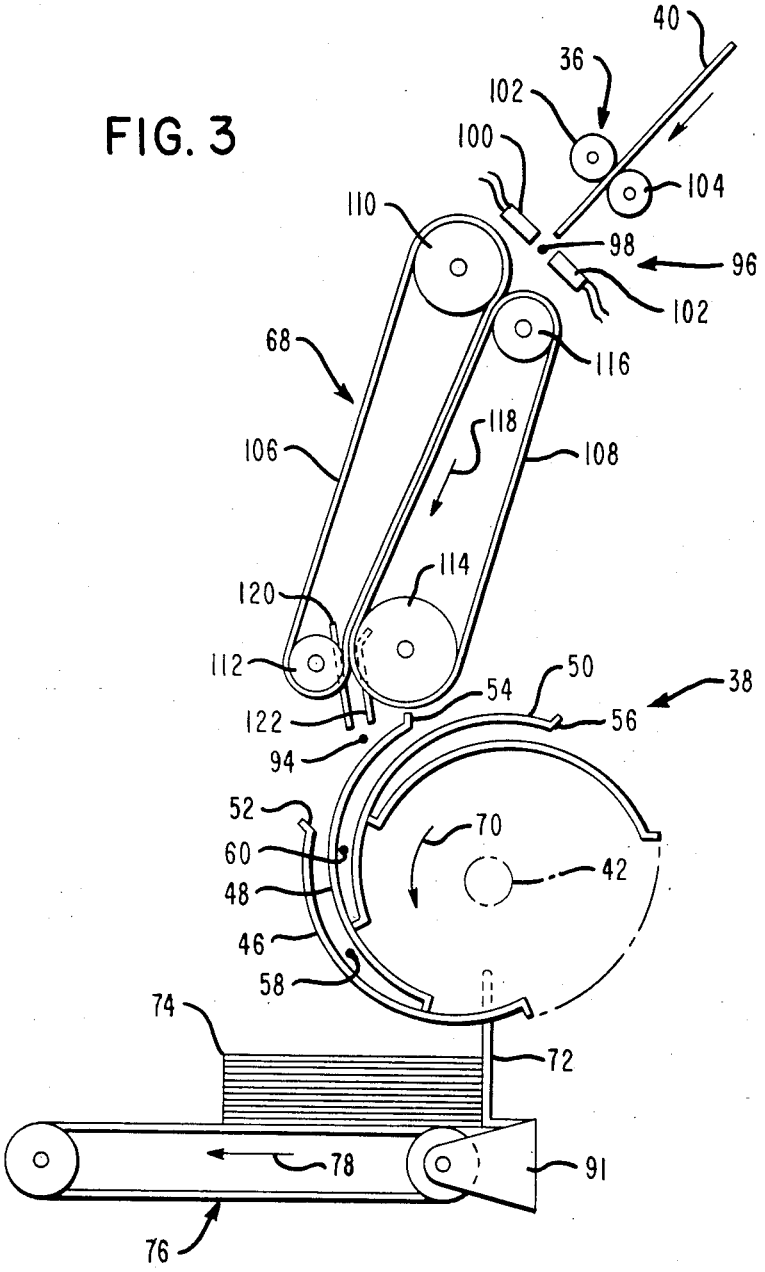
FIG. 3 is a side view, in elevation as seen from the direction B of FIG. 1, showing more details of the transports shown in FIG. 1.

FIG. 3 is a side view, in elevation, as seen from the direction of arrow B in FIG. 1, to show more details of the transports 36 and 68, shown only in block form in FIG. 1. The transport 36 may include conventional rollers such as drive roller 102 and pinch or back-up roller 104 to transport the note 40 therebetween. The transport 68 may include conventional spaced, opposed, endless belts such as 106 and 108. Belt 106 is mounted on associated rollers 110 and 112. Similarly, endless belt 108 is mounted on rollers 114 and 116. The rollers 110 and 114 are rotated at a constant velocity so as to transport a note 40 carried between the belts 106 and 108 in the direction of arrow 118 at a constant velocity as previously stated. The rollers 112 and 114, for example, and the associated belts 106 and 108 may be sectional so as to permit the insertion of guides 120 and 122 which direct the leading edge of a note like 40 to the loading point 94.

The apparatus 12 also includes means 124 (FIG. 1) for determining the rotational position of the stacker wheel 38 with regard to the loading point 94. The determining means 124 includes a timing disc 126 having a plurality of radially-aligned slits 128 therein, with the disc 126 having a bushing and screw 129 thereon to enable it to be fixed, adjustably, to the shaft 42 and to be rotated therewith. There is one slit such as 128 provided for each compartment like 58 or 60 of the stacker wheel 38. A source of light 130 is positioned on one side of the disc 126 while a compatible detector 132 is positioned on the opposite side thereof. The disc 128 is positioned on the shaft 42 so that the detector 132 produces a signal when adjacent finger ends like 52 and 54 are equally spaced from point 94 which represents the loading area at which the leading edge of a note like 66 enters a compartment like 58 of the stacker wheel 38. After aligning the disc 126 and the stacker wheel 38 in this manner, the disc 126 is fixed to the shaft 42 via a tightening of screw 129.

The apparatus 12 (FIG. 1) further includes a means 134 for rotating the stacker wheel 38 and also for varying its rotational velocity, when necessary, in response to the signals from the detectors 102 and 132 so as to enable the leading edge of a note like 66 to enter a compartment like 58 without contacting the ends 52 and 54 of the associated fingers 46 and 48, respectively, and the means 134 for rotating and varying the rotational velocity of the stacker wheel 38 (shown only diagrammatically in FIG. 1) will be referred to hereinafter as position controller 134.

There are two embodiments of the position controller 134 shown in FIG. 1 to be disclosed herein. The first position controller 134-1 is shown in FIG. 2 and includes a motor 136 whose output shaft is secured to a conventional slip clutch 138 whose output in turn, is secured to the shaft 42 to rotate it and the stacker wheel 38 secured thereto. The controller 134-1 also includes a brake mechanism 140 which is shown in FIG. 4.

Figure 4:
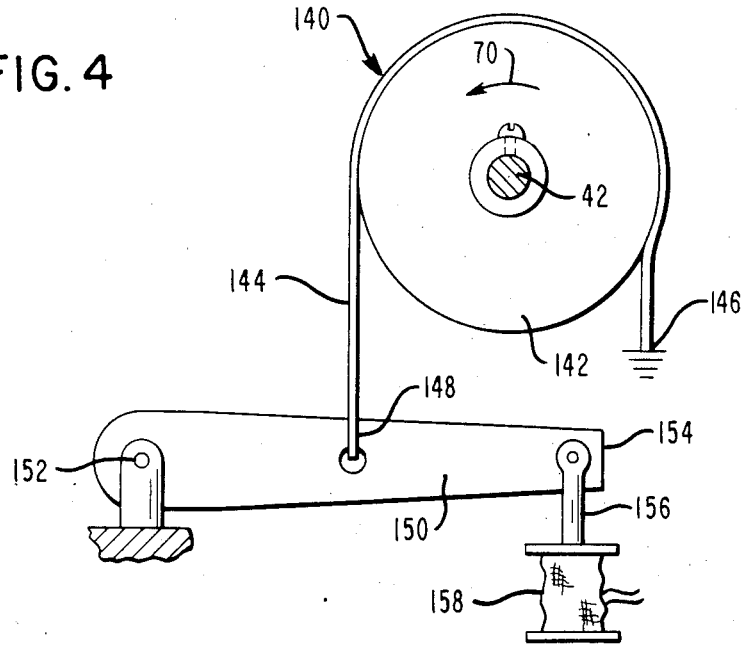
FIG. 4 is a view taken along line 4—4 of FIG. 2 to show additional details of a brake mechanism used in the first embodiment.

FIG. 4 is a view taken along line 4—4 of FIG. 2 to show additional details of the brake mechanism 140. The mechanism 140 includes a brake drum 142 which is fixed to the shaft 42 to rotate therewith, and also includes a flexible metal band 144 which engages a portion of the periphery of the drum 142 as shown. One end 146 of the band 144 is stationary and the remaining end 148 thereof is pivotally joined to a lever 150 between its pivot point 152 and its actuating end 154. The actuator arm 156 of solenoid 158 is pivotally joined to the actuating end 154 of the lever 150, and when the solenoid 158 is energized or actuated, as will be described hereinafter, the lever 150 is pivoted about the pivot point 152 in a clockwise direction (as viewed in FIG. 4) to cause the band 144 to decelerate the rotational velocity of the drum 142, the shaft 42, and correspondingly, the stacker wheel 38. When the solenoid 158 is deenergized, the brake mechanism 140 is released, permitting the motor 136 to accelerate the stacker wheel 138 towards its nominal speed. The slip clutch 138 enables the brake mechanism 140 to decelerate the stacker wheel, when necessary, while the motor 136 is driven at a substantially constant speed.

FIG. 5 is a schematic diagram, in block form, showing a circuit 154, associated with the embodiment 34-1 shown in FIG. 2, and FIG. 6 shows a plurality of timing diagrams associated with the circuit 154. The detector 132 (also shown in FIG. 1) produces a series of wheel position pulses hereinafter conveniently referred to as WPP's. The WPP's coming from detector 132 are fed into a conventional shaper 156 which squares up or shapes these pulses to produce at the output thereof pulses referred to as WPP-1 and shown in timing diagram 158 in FIG. 6. Some illustrative parameters would be useful in explaining the operation of circuit 154.

Assuming a constant linear velocity of 50 inches per second as the rate for feeding a note like 66 from transport #2 referenced as 68 in FIG. 1 to the stacker wheel 38, the following parameters apply. The stacker wheel 38 is rotated by motor 136 slightly faster, by about 5%, compared to what may be considered a nominal velocity for compatability with the velocity of a note coming from transport #2. This is due to the fact that adjustments to the stacker wheel 38 in embodiment 134-1 are made only by decelerating the wheel 38. Accordingly, the time between successive WPP's coming from the disc 126 and detector 132 is about 95 milliseconds, and the time duration of a WPP-1 pulse such as 160 on timing diagram 158 is for example, 33 milliseconds.

Each pulse resulting from the presence of a note 40 at point 98 in FIG. 1 and coming from the detector 102, is referred to as a note present pulse (NPP). The NPP is squared or shaped by a conventional pulse shaper 162, shown in FIG. 5, producing the square pulses 164 and 166 shown in FIG. 6. The pulse 164 is shown in dashed outline and the pulse 166 is shown in solid outline on timing diagram 168 simply to illustrate different entrance times relative to loading point 94 associated with the stacker wheel 38. The leading edges 164-1 and 166-1 of pulses 164 and 166 are used to trigger a one-shot 170 or time delay, to produce corresponding outputs NPP-2, shown as pulses 172 and 174, respectively, on timing diagram 178. The time duration of each of the pulses 172 and 174 is one millisecond in the embodiment described. The output WPP-1 of the pulse shaper 156 and the output NPP-2 of the one-shot 170 are fed into an AND gate 176. An active level output from AND gate 176 means that the leading edge like 180 of a pulse like 172 (FIG. 6) occurs within the time duration of pulse 160. When looking at FIG. 1, this means that a note like 40 is present at the detector 102 at a time when the stacker wheel 38 is positioned relative to loading point 94 to receive a note therein. It should be recalled that the motor 136 (FIG. 2) turns the stacker wheel 38 at a speed slightly faster than is required for the velocity of transport #2 to allow for a decelerating correction as previously explained. The decelerating correction is provided by feeding the output of AND gate 176 (FIG. 5) into a conventional control pulse shaper 182 which determines the width and amplitude of the brake control pulse (BCP) 184 which is about 5 milliseconds long in the example being described. After the stacker wheel 38 is momentarily decelerated, the note like 40 whose presence was detected at detector 102 will enter the next compartment like 60 in the stacker wheel 38 without hitting the finger ends like 54 and 56.

If the leading edge of an NPP-1 pulse like 166-1 in FIG. 6 does not occur within one of the WPP-1 pulses like 160, it means that no braking pulse is necessary, and consequently, no BCP occurs on timing diagram 186 for that NPP-1 pulse like 166.

The BCP coming from the pulse shaper 182 in FIG. 5 is fed into a conventional brake driver 188 which contains the usual power transistors (not shown) to drive or energize the brake solenoid 158 as previously explained.

Figure 7:
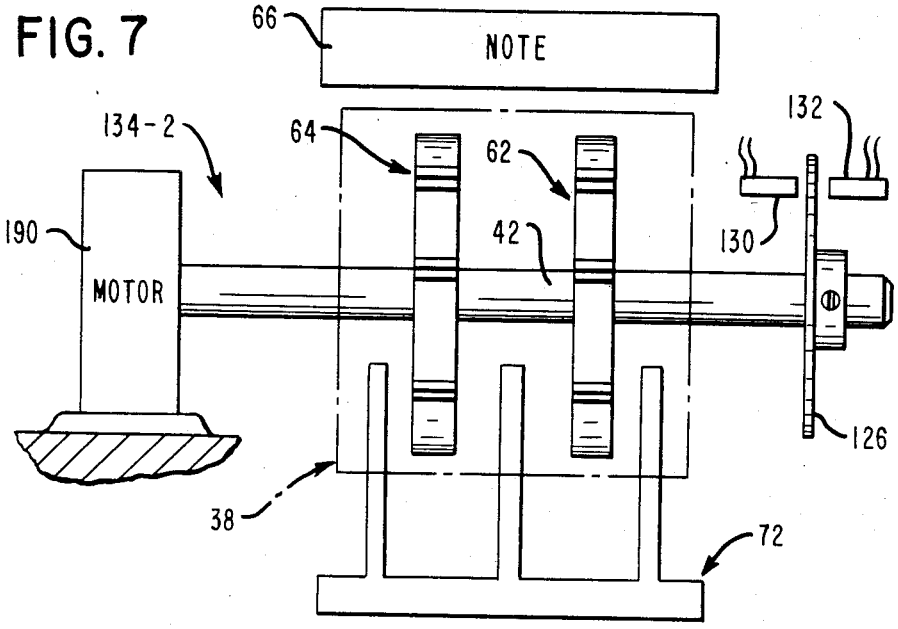
FIG. 7 is a diagrammatic view similar to FIG. 2, but showing a second embodiment of this invention.

FIG. 7 is a view similar to FIG. 2 but shows a second embodiment of the position controller 134 (FIG. 1) which is designated generally as 134-2, with parts identical to those shown in FIG. 2 being assigned the same reference numbers.

Figure 8:
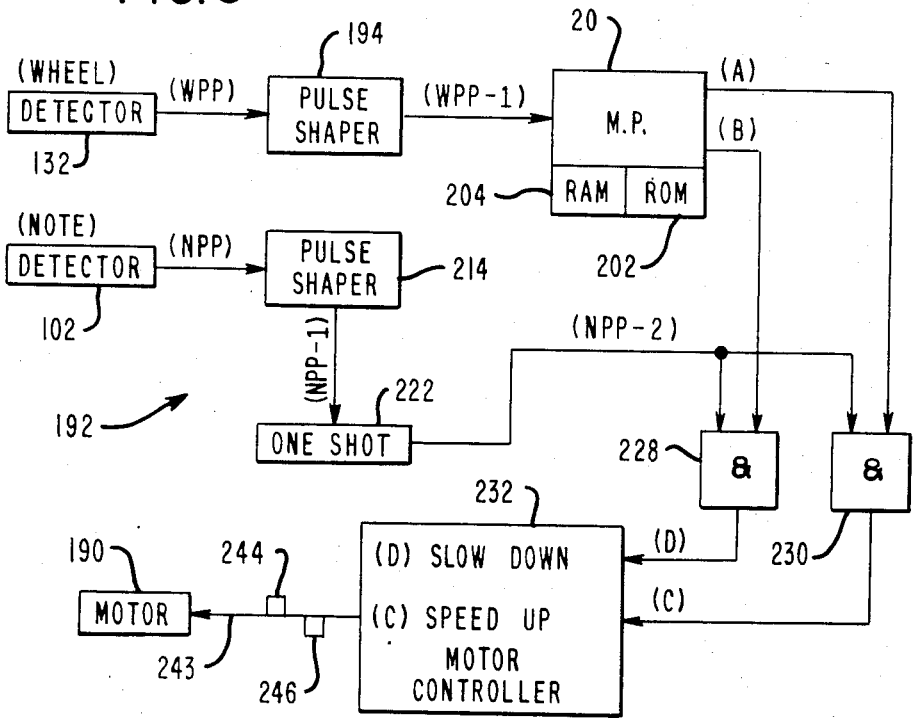
FIG. 8 is a schematic diagram, in block form, showing a circuit associated with the embodiment of the invention shown in FIG. 7.

The second embodiment 134-2 includes a motor 190 and a circuit 192 shown in FIG. 8. In this embodiment 134-2, the motor 190 is driven at a nominal speed and the circuit 192 will cause it to be speeded up or slowed down as is necessary so as to enable a note like 66 to enter a cavity like 58 (FIG. 1) without hitting the associated finger ends like 52 and 54. The motor 190 may be a conventional D.C. motor of the type which has a permanent magnet used in the stator thereof. Under this circumstance, the only variable which is introduced to the motor 190 is the voltage to the rotor thereof. The motor 190 rotates the stacker wheel 38 at a nominal speed of 1¼ revolutions per second or 75 revolutions per minute, for example, and with eight slits like 128 in the disc 126, as previously explained, the detector 132 produces an output pulse every 100 milliseconds.

Figure 9:
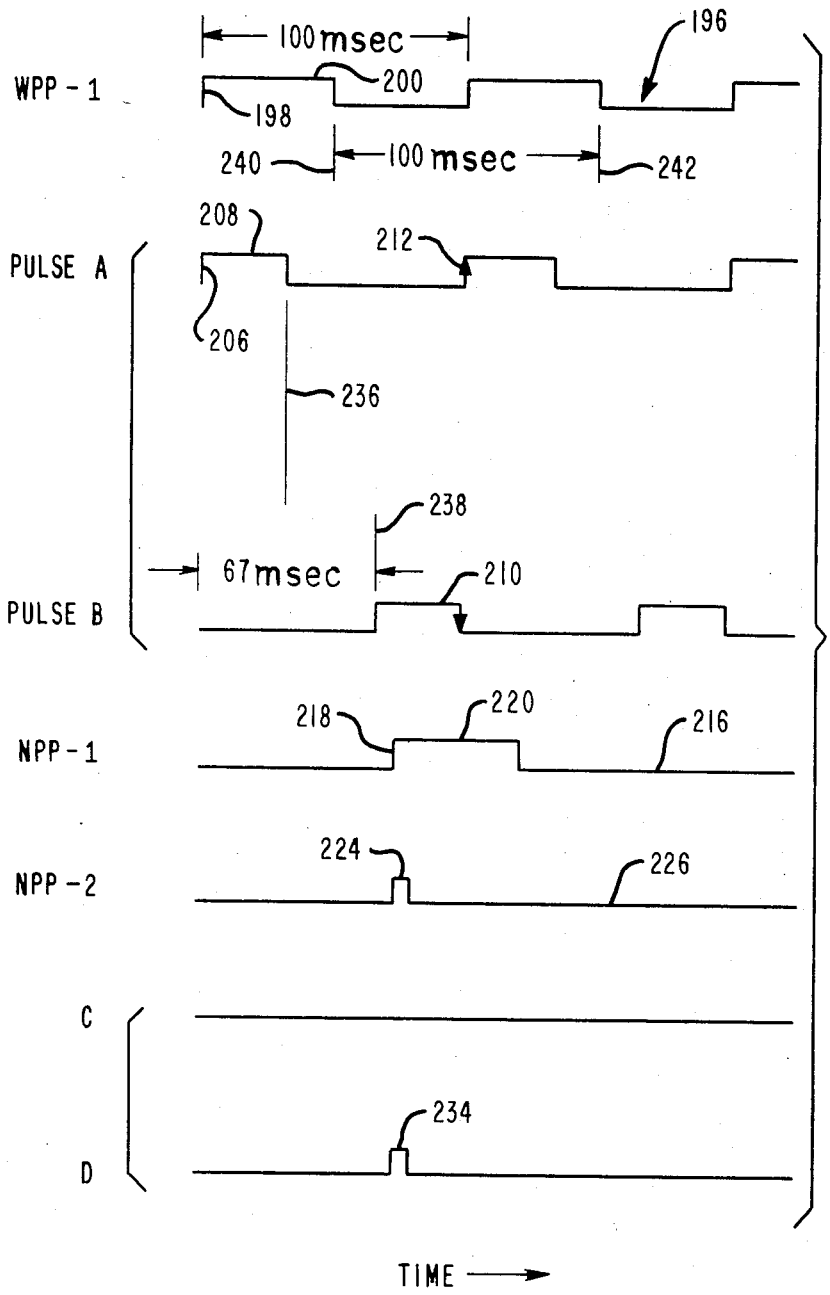
FIG. 9 shows a plurality of timing diagrams associated with the circuit shown in FIG. 8.

Each wheel position pulse (WPP) coming from the detector 132 is shaped by a conventional pulse shaper 194 (FIG. 8) whose output (WPP-1) is shown as timing diagram 196 in FIG. 9. The leading edge 198 of a pulse like 200 is used by the microprocessor 20 (also shown in FIG. 1) to generate, conventionally, pulses A and B. The microprocessor 20 has the usual ROM 202 and RAM 204 associated therewith for effecting the generation of the pulses A and B. The leading edge 198 of a WPP-1 pulse like 200 is used to generate the leading edge 206 of the A pulse 208, and this leading edge is used to generate the start of a 67 millisecond time period. The end of this 67 millisecond time period is used to initiate the start of a pulse B which is also shown as 210. The time duration of each of the pulses A is 33 milliseconds; however, the time duration of each of the pulses B does not reflect a time-out situation, but each pulse B is curtailed by the rise of the next pulse A. For example, the leading edge 212 of pulse A causes the termination of pulse B, also marked as 210. The generation of pulses A and B could also be effected by conventional logic circuitry; however, it was advantageous to use the microprocessor 20, associated with the machine 10, for this purpose.

In addition to the pulses A and B, the circuit 92 (FIG. 8) utilizes the note present pulse (NPP) from the detector 102 (FIG. 1) in the second embodiment 134-2 of the position controller. An NPP coming from the detector 102 (FIG. 8) is squared or shaped by a conventional pulser or shaper 214 whose output is NPP-1 and is shown as waveform 216 shown in FIG. 9. The leading edge 218 of the pulse 220, shown on waveform 216, is used to trigger a one shot 222 to produce the NPP-2 pulse 224 shown on waveform 226. The time duration of pulse 224 is extremely short, being 1 millisecond in the example being described. The purpose of the NPP-1 pulse is to produce the NPP-2 pulse as described; however, the NPP-1 pulse may also be used in a counting function for the notes to be dispensed by the machine 10.

The NPP-2 pulses are fed into one input of the AND gates 228 and 230 (FIG. 8). The A pulses from the MP 20 are fed into the remaining input of AND gate 230, and similarly, the B pulses are fed into the remaining input of AND gate 228. The significance of ANDing the NPP-2 pulses with the A and B pulses is as follows. When an NPP-2 pulse, like 224, coincides with an A pulse, such as 208, in FIG. 9, it means that an active output (C) will be generated by the AND gate 230. The active C output, when fed to a conventional motor controller 232, will produce a "speed-up" situation with regard to the motor 190. Contrastly, when a NPP-2 pulse is coincident with a B pulse, the output of AND gate 228 becomes active, producing a D output which is fed into the motor controller 232, causing a "slow down" situation with regard to the motor 190. As an example, an NPP-2 pulse, also marked 224 in FIG. 9, is shown as occurring within the time duration of a B pulse, also marked 210, to produce a D pulse, also marked 234 in FIG. 9. When an NPP-2 pulse such as 224 occurs between the fall of an A pulse, as represented by line 236, and the rise of a B pulse, as represented by line 238, the motor 190 does not need to be "speeded up" or "slowed down" in order to have a note like 40 in FIG. 1 arrive at the loading point 94 to enter into a compartment like 60 without hitting the associated finger ends 54 and 56. With regard to the example being given, this means that the leading edge of the note 40 will take 100 milliseconds to travel from the detection point 98 to the loading point 94. Naturally, different times and parameters may be used with this invention; accordingly, the times and illustrations discussed herein are merely exemplary. Also, the 100 millisecond interval between successive notes like 66 being fed into the stacker wheel 38 is shown between the lines 240 and 242 in FIG. 9; this represents a very regular situation in which the stacker wheel 38 does not have to be accelerated or decelerated to receive the notes like 66 without malfunction. However, this very regular situation is not typical because the notes like 40 coming from the transport 36 (FIG. 1) do not arrive at detection point 98 in equally-spaced or timed relationship, but they tend to arrive there asynchronously.

There is another timing factor with regard to FIG. 9 which needs discussing. If the leading edge like 218 of an NPP-1 pulse occurs when the leading edge 212 of pulse A is rising, it means that the pulse B will be falling at that moment. Because the NPP-2 pulse is derived from an associated NPP-1 pulse, it is conceivable that an NPP-2 pulse and the rising situation with pulse A and the falling situation with pulse B may cause the outputs of AND gates 230 and 228 to change to the active level, producing simultaneous outputs C and D, respectively. This would represent contradictory instructions to the motor controller 232 (FIG. 8); in such a situation, the controller 232 simply ignores both the C and D inputs thereto and no change in rotational velocity is made to the motor 190. A motor controller such as #350 Series Controller which is manufactured by Electro-Craft Corporation may be used for controller 232. A "speed up" situation represented by pulse C produces an increased voltage (above the nominal voltage shown by line 243) to the motor 190 as represented by ramp pulse 244, and correspondingly, a "slow down" situation represented by ramp pulse D produces a decreased voltage to the motor 190 as represented by pulse 246. Short pulses such as 244 and 246 are sufficient to effect the necessary speeding up and slowing down of motor 190, with the absolute magnitude and time duration of these pulses being dependent upon the specific parameters and equipment selected to implement the second embodiment 134-2.

We claim:

1. In a media dispensing apparatus, the combination comprising:

a stacker wheel rotatably mounted in said apparatus;

said stacker wheel having compartments located around the periphery thereof with each said compartment having spaced ends providing an entrance area to the associated one of said compartments;

means for transporting media in spaced relationship along a path leading to a loading area with regard to said stacker wheel;

means for detecting the presence of a leading edge of one of said media in said path at a predetermined point from said loading area and also for generating a first signal in response thereto;

means for determining the rotational position of each said compartment of said stacker wheel with regard to said loading area to produce a second signal indicative of said position; and means for rotating said stacker wheel and also for varying the velocity, when necessary, of said stacker wheel in response to said first and second signals so as to enable the leading edge of one of said media to be moved into a said compartment by said transporting means without contacting the associated said ends;

said means for rotating said stacker wheel and also for varying said velocity, hereinafter referred to as position controller, will vary said velocity, when necessary, in only a first direction; and said stacker wheel having a shaft to rotate it and said position controller comprising:

a motor;

a resilient coupling means being operatively coupled between said motor and said shaft; and a means for decelerating said shaft being operatively coupled to said shaft whereby as said motor rotates said shaft and stacker wheel via said resilient coupling means, said decelerating means will reduce said velocity of said shaft and stacker wheel in response to said first and second signals.

2. The combination as claimed in claim 1 in which said decelerating means comprises:

a brake drum secured to said shaft;

a band engaging at least a portion of the periphery of said brake drum, with said band having a stationary end and a moveable end; and an actuator mechanism including an actuator coupled to said moveable end to move said band into braking engagement with said periphery when said actuator is energized to thereby reduce said velocity of said stacker wheel.

3. The combination as claimed in claim 2 in which said position controller further comprises circuit means for receiving said first and second signals;

means for producing third signals of a predetermined time duration from each said first signal as successive leading edges of said media are detected; and means for producing a braking signal whenever one of said third signals occurs within the time duration of one of said second signals, said braking signal being used to energize said actuator to momentarily, reduce the velocity of said stacker wheel.

4. The combination as claimed in claim 3 in which said determining means comprises:

a timing disc secured to said shaft to rotate therewith, with said timing disc having a plurality of radially aligned slits therein, and with one said slot being provided for each said compartment located on said stacker wheel;

a light source and a detector positioned in operative relationship with said timing disc to produce a said second signal each time a said slit passes between said light source and detector.

5. In a media dispensing apparatus, the combination comprising:

a stacker wheel rotatably mounted in said apparatus;

said stacker wheel having compartments located around the periphery thereof with each said compartment having spaced ends providing an entrance area to the associated one of said compartments;

means for transporting media in spaced relationship along a path leading to a loading area with regard to said stacker wheel;

means for detecting the presence of a leading edge of one of said media in said path at a predetermined point from said loading area and also for generating a first signal in response thereto;

means for determining the rotational position of each said compartment of said stacker wheel with regard to said loading area to produce a second signal indicative of said position; and means for rotating said stacker wheel and also for varying the velocity, when necessary, of said stacker wheel in response to said first and second signals so as to enable the leading edge of one of said media to be moved into a said compartment by said transporting means without contacting the associated said ends;

said means for rotating said stacker wheel and also for varying said velocity, when necessary, comprising:

a variable-speed motor for rotating said stacker wheel at a nominal velocity;

circuit means for receiving said first and second signals and for generating speed-up and slow-down signals therefrom for speeding up or slowing down said mtor so as to enable the leading edge of one of said media to be moved into a said compartment wilhout contacting the associated said ends;

said circuit means also comprising:

first means for producing third and fourth signals of predetermined time durations from said second signals;

second means for producing fifth signals of predetermined time durations from said first signal;

third means for producing said speed-up signal upon the coincidence of a said fifth signal and a said third signal, and also for producing a said slow-down signal upon the coincidence of a said fifth signal and a said fourth signal.

6. The combination as claimed in claim 5 in which said transporting means includes a first transport means for transporting one of said media from said predetermined point to said loading area in a constant, predetermined time, and in which said motor rotates said stacker wheel at said nominal velocity so as to present adjacent successive said compartments to said loading point within said constant, predetermined time.

7. The combination as claimed in claim 6 in which said apparatus has a processor and operating system associated therewith, and in which said first means includes said processor and operating system.

8. The combination as claimed in claim 7 in which said stacker wheel has a shaft to rotate it and in which said determining means comprises:

a timing disc secured to said shaft to rotate therewith, with said timing disc having a plurality of radially aligned slits therein, and with one said slit being provided for each said compartment located on said stacker wheel; and a light source and a detector positioned in operative relationship with said timing disc to produce a said second signal each time a said slit passes between said light source and detector.

* * * * *